US006270396B1

(12) United States Patent
Uchiyama

(10) Patent No.: US 6,270,396 B1
(45) Date of Patent: Aug. 7, 2001

(54) CONDITIONING APPARATUS AND CONDITIONING METHOD

(75) Inventor: Shinzo Uchiyama, Utsunomiya (JP)

(73) Assignee: Canon Kabushika Kaisha, Tokyo (JP)

( * ) Notice: Subject to any disclaimer, the term of this patent is extended or adjusted under 35 U.S.C. 154(b) by 0 days.

(21) Appl. No.: 09/348,657

(22) Filed: Jul. 6, 1999

(30) Foreign Application Priority Data

Jul. 6, 1998 (JP) ..... 10-190301
Jun. 24, 1999 (JP) ..... 11-178478

(51) Int. Cl.[7] ..... B24B 1/00
(52) U.S. Cl. ..... 451/56; 451/443; 451/444
(58) Field of Search ..... 451/56, 443, 444, 451/449

(56) References Cited

U.S. PATENT DOCUMENTS 2,541,912 * 2/1951 Broughton ..... 451/56
5,216,843 * 6/1993 Breivogel et al. ..... 51/131.1
5,569,062 * 10/1996 Karlsrud ..... 451/285
5,584,750 * 12/1996 Ishida et al. ..... 451/288
5,643,067 * 7/1997 Katsuoka et al. ..... 451/444
5,807,167 * 9/1998 Walsh ..... 451/56
5,827,112 * 10/1998 Ball ..... 451/21
5,885,147 * 3/1999 Kreager et al. ..... 451/443
5,890,951 * 4/1999 Vu ..... 451/56
5,958,794 * 9/1999 Bruxvoort et al. ..... 438/692
5,961,372 * 10/1999 Shendon ..... 451/41
5,984,764 * 11/1999 Saito et al. ..... 451/56
6,042,688 * 3/2000 Masumura et al. ..... 156/345

* cited by examiner

*Primary Examiner*—Derris H. Banks
*Assistant Examiner*—Hadi Shakeri
(74) *Attorney, Agent, or Firm*—Fitzpatrick, Cella, Harper & Scinto

(57) ABSTRACT

An apparatus and a method are provided for uniformly conditioning a polishing pad over the entire surface. The conditioning is achieved by contacting the entire polishing surface of the polishing pad with a polishing pad conditioner having a surface area larger than that of the polishing pad.

30 Claims, 13 Drawing Sheets

CONDITIONING APPARATUS AND CONDITIONING METHOD

BACKGROUND OF THE INVENTION

1. Field of the Invention

The present invention relates to an apparatus and a method for conditioning the polishing surface of a polishing pad with high precision.

2. Related Background Art

With the recent progress in the ultra fine geometry and in the multi-layered wiring of the semiconductor devices, there is being required high precision polishing apparatuses for flattening the surface of a substrate such as semiconductor wafer for example of Si, GaAs, InP or SOI, with high precision. Among such apparatuses, there is known a chemical mechanical polishing (CMP) apparatus for flattening the surface of a substrate such as a wafer on which the semiconductor devices are formed, with high precision.

The CMP apparatuses can be divided into two types as shown in FIGS. 1 and 2.

(1) FIG. 1 is a schematic view of a polishing part of a CMP apparatus for executing the polishing operation in the state of facing the surface to be polished of a wafer 100 downwards.

As shown in FIG. 1, the wafer 100 is supported by a wafer chuck 400 in the state of facing the polished surface downwards and is pressed, in the state of rotation of the wafer (Hereinafter, "rotation" means the action of an object of turning on its own axis.), to a polishing pad 200 of a diameter larger than that of the wafer 100 to thereby polish the wafer. In the polishing operation, a polishing agent (slurry) 300 is supplied by dripping onto the upper surface of the polishing pad 200.

The wafer chuck 400 supports the wafer 100 by attachment utilizing, for example, vacuum suction, wax, solution or deionized water, and a guide ring (not shown in the drawings) may be provided along the periphery of the wafer 100 in order to prevent displacement thereof. The diameter of the polishing pad 200 on a polishing table 500 is 3 to 5 times that of the wafer 100, and the slurry consists of a suspension of finely powdered silicon oxide mixed in the aqueous solution of potassium hydroxide.

As shown in FIG. 1, the CMP apparatus is further provided with conditioning means 600. The conditioning means 600 has an annular shape with a diameter smaller than that of the polishing pad 200, and is maintained in contact with a part of the polishing pad 200. The conditioning means 600 moves on the polishing pad 200 while executing a rubbing movement such as rotation or swinging, thereby removing the particles of the slurry and the polished wastes generated in the polishing operation from the entire surface of the polishing pad 200.

There is also proposed, as illustrated in FIG. 2, a method of supporting a wafer 100 in the state of facing the surface to be polished upwards by a wafer chuck 800 provided on a wafer table 700 and having a guide ring (not shown in the drawings) and then polishing the wafer 100 with a polishing pad 900 of a diameter smaller than that of the wafer 100.

Such polishing apparatus and method are suitable for polishing the currently employed semiconductor wafers of 8 inches in diameter, but it is said that the wafers are shifted from 8 inches to 12 inches in the near future, following the continuing progress in the semiconductor technology toward the finer geometry of the integrated circuits and the larger diameter of wafer.

For polishing the wafer of a large diameter, the above-described technology is associated with the following technical problems.

In the above-described polishing apparatus, in polishing the 8-inch wafer, the polishing performance is adjusted by optimizing the thickness and elasticity of the polishing pad, but it is difficult to achieve delicate adjustment or to maintain uniformity in the material of the polishing pad, so that high-quality polishing is difficult to attain in the wafer of a larger diameter such as 12 inches.

For example, in case of employing a polishing pad of a diameter smaller than that of the wafer as described in the foregoing, it is difficult to obtain a uniform polishing amount over the entire surface of the wafer. Also there is required a long polishing time in case of polishing the entire surface of the wafer with a polishing pad of a diameter smaller than that of the wafer. Also in case of polishing the entire wafer with a polishing pad of a diameter larger than twice that of the wafer, the polishing amount becomes larger in the central area of the polishing pad than in the peripheral area of the polishing pad, because of the circumferential speed between the central area of rotation of the polishing pad and the peripheral area thereof, so that it is difficult to control the polishing amount. Also, since the rotation of the polishing pad is executed while only a part of the polishing pad is in contact with the wafer, it may be degraded, abraded or even deformed in a donut shape. Furthermore, the polishing pad may be deformed by the pressure applied thereto during the wafer polishing. All these phenomena cause the degradation of the uniformity of polishing and the flatness by the polishing.

Also in case of polishing the surface of a wafer to be polished facing downwards by the polishing pad of a diameter larger than twice that of the wafer as described in the foregoing, the polishing agent is supplied not only to the area of the polishing pad in contact with the wafer but also to the entire surface of the polishing pad. For this reason, there is consumed a large amount of the polishing agent, thereby leading to a higher cost.

Also in the above-described polishing apparatus, it is difficult to achieve uniform conditioning over the entire surface of the polishing pad with the conditioning means. This is because the conditioning means is in contact with only a part of the polishing pad. More specifically, the polishing pad is deformed at the boundary of an area in contact with the conditioning means and an area not in contact therewith, and this causes generation of uneven conditioning in such deformed part.

As explained above, the above-described conditioning technology results, within the conditioned polishing pad, in an area sufficiently conditioned having a high polishing ability and an area not sufficiently conditioned.

It is difficult to uniformly polish the substance to be polished such as a wafer by using the polishing pad showing such unevenness.

Also in case of employing the conditioning means with an area smaller than that of the polishing pad, there is required a long time for conditioning the entire surface of the polishing pad.

SUMMARY OF THE INVENTION

An object of the present invention is to provide an apparatus and a method for executing conditioning with a high productivity for a short time, and a polishing apparatus and a polishing method utilizing such conditioning apparatus.

In order to solve the above-mentioned problems, the present invention provides a conditioning apparatus comprising a polishing head for supporting a polishing pad, a polishing pad conditioner support means for supporting a polishing pad conditioner having a conditioning surface larger than that of the polishing pad, and contact means for contacting the polishing pad supported by the polishing head and the polishing pad conditioner supported by the polishing pad conditioner support means.

The present invention also provides a conditioning method of conditioning a polishing pad, which comprises contacting a polishing pad and a polishing pad conditioner having a surface larger than the polishing pad.

Further, the present invention provides a conditioning apparatus comprising a polishing head, and a polishing pad conditioner support means having a surface larger than that of the polishing head.

According to the present invention, there is employed a polishing pad conditioner with a surface larger than that of the polishing pad to be able to condition the entire surface of the polishing pad at the same time.

As a result, the polishing pad can be uniformly conditioned over the entire surface within a short time. Also a member to be polished can be polished with thus conditioned polishing pad, whereby the member to be polished can be uniformly polished over the entire area thereof.

DESCRIPTION OF THE PREFERRED EMBODIMENTS

[Embodiment 1]

Figure 3:
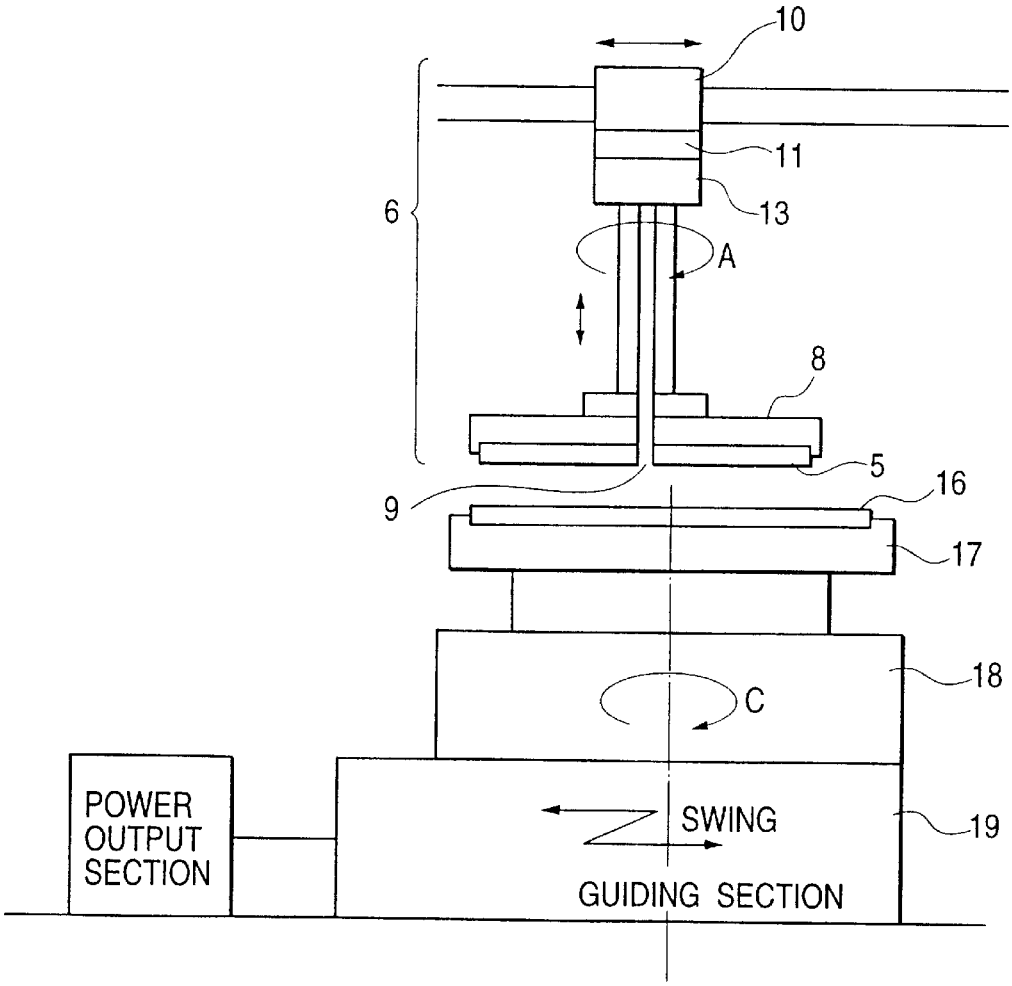
FIG. 3 is a schematic view of a conditioning apparatus according to the first embodiment of the present invention.

The conditioning apparatus according to Embodiment 1 of the present invention comprises, as shown in FIG. 3, a polishing head for supporting a polishing pad, polishing pad conditioner support means for supporting a polishing pad conditioner having a conditioning surface with an area larger than that of the polishing surface of the polishing pad, and contact means for contacting the polishing surface of the polishing pad supported by the polishing head and the conditioning surface of the polishing pad conditioner supported by the polishing pad conditioner support means.

In the present embodiment, the term "conditioning" means the increase of the polishing ability of the polishing surface of the polishing pad. More specifically the conditioning includes removal of unnecessary materials such as polished wastes and polishing particles from the polishing surface, thereby restoring the polishing ability lowered after polishing operation, and polishing of the polishing surface into a desired surface.

A polishing head 6 is provided with a platen 8 which detachably supports on the supporting surface of the platen 8 a polishing pad 5 in the state of facing the polishing surface of the pad downwards. The polishing pad 5 is composed of an elastic member such as polyurethane and has recesses of a size of several to several hundred micrometers on the polishing surface thereof.

Polishing pad conditioner support means 17 supports a polishing pad conditioner 16 on the supporting surface thereof.

The polishing pad conditioner 16 is a relatively hard member composed of, for example, an urethane sheet on which abrasive diamond grains are dispersed on the entire conditioning surface.

The rotation of the polishing head 6 is executed in the direction of an arrow A by second driving means 11.

Also the rotation of the polishing pad conditioner support means 17 is executed in the direction of an arrow C by sixth driving means 18. The rotation of the polishing pad conditioner support means 17 is executed within a range of several rpm to several ten thousand rpm, independently from the rotation of the polishing head 6, in the same direction at the same rotation speed or with a slightly different rotation speed.

The polishing pad 5 is vertically moved by fourth driving means 13 which is the contact means for contacting the polishing pad 5 and the polishing pad conditioner 16, thereby bringing the polishing pad 5 into contact with the polishing pad conditioner 16. The rotations of the polishing pad 5 and the polishing pad conditioner 16 are independently executed to generate a rubbing movement, whereby the conditioning is achieved.

The diameter of the polishing pad conditioner 16 is selected within a range of not smaller than the diameter of the polishing pad 5 but smaller than twice the diameter of the polishing pad 5.

The polishing head 6 is rendered movable by first drive means 10. The polishing pad conditioner 16 and the polishing pad 5 are contacted in a mutually displaced state such their centers are not mutually concentric. The distance between their centers can be suitably selected, but the sum of the distance between their centers and the radius of the polishing pad 5 is set to be not larger than the radius of the polishing pad conditioner 16 so that, during the conditioning operation, the entire surface of the polishing pad 5 is constantly covered by the polishing pad conditioner 16.

Also seventh driving means 19 causes the polishing pad conditioner support means 17 to execute a swinging motion, whereby the polishing pad 5 is conditioned more uniformly over the entire surface thereof. Further, the polishing pad can be conditioned uniformly over the entire surface thereof because the unevenness of the conditioning due to the circumferential speed which increases proportionally with the distance from the center of rotation can be significantly reduced.

Also in the course of conditioning operation, a liquid is supplied through a small hole 9 provided in the platen 8 between the polishing pad and the polishing pad conditioner. The liquid is usually a liquid component employed in the polishing agent such as an aqueous solution of potassium hydroxide (KOH), an aqueous solution of isopropyl alcohol or deionized water. It is thus possible to effectively remove the wastes such as polished wastes or the slurry. Also the polishing pad 5 is moistened with the liquid supply, thereby preventing the influence by the heat caused by the friction with the polishing pad conditioner 16. As a result, it is rendered possible to stably maintain the surface shape of the polishing surface of the polishing pad 5, thereby maintaining the polishing performance.

Figure 4:
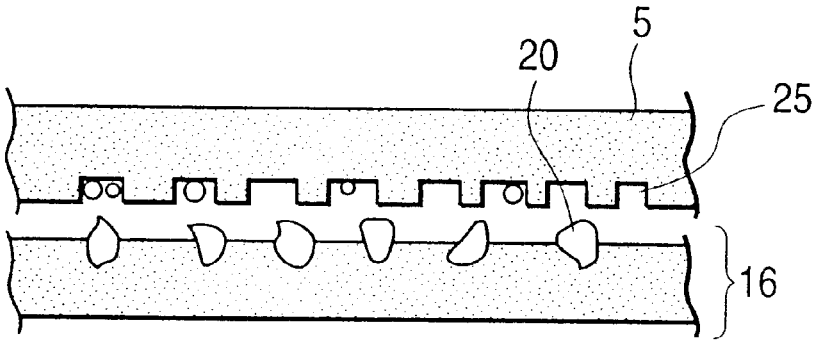
FIG. 4 is a schematic view of a polishing pad and a polishing pad conditioner.

In the following there will be explained the manner of removing the powders stuffed in the recesses of the polishing pad 5, by the polishing pad conditioner 16 of the conditioning apparatus of the present embodiment. FIG. 4 is a schematic magnified side view of the polishing pad 5 before the conditioning and the polishing pad conditioner 16 opposed thereto, in the conditioning apparatus of the present embodiment. As explained in the foregoing, the polishing pad 5 is provided with recesses 25, in which powders such as abrasive grains are stuffed. Also as explained in the foregoing, the polishing pad conditioner 16 is provided with abrasive diamond grains 20 on the conditioning surface. The abrasive diamond grains 20 have a diameter of several micrometers to several hundred micrometers, and are adhered to a hard member.

Figure 5:
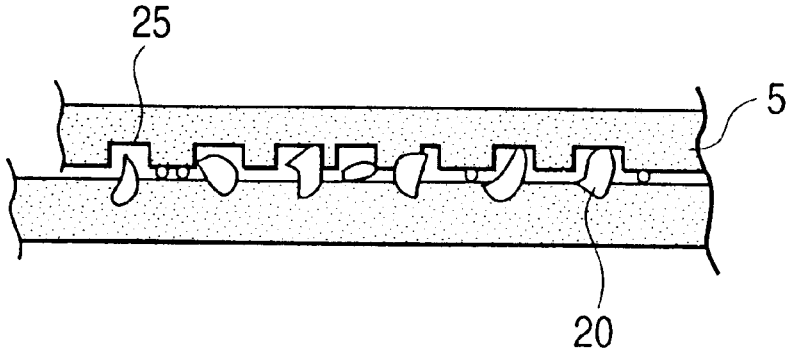
FIG. 5 is a schematic view of a polishing pad and a polishing pad conditioner in a state of mutually contacting them.

FIG. 5 is a schematic magnified side view showing the conditioning state of the polishing surface of the polishing pad 5 by the polishing pad conditioner 16 in the conditioning apparatus of the present invention. As shown in FIG. 5, the abrasive diamond grains 20 can scrape off the powders stuffed in the recesses 25 of the polishing pad 5. The above-mentioned powders mean polished wastes, abrasive grains contained in the slurry (polishing agent) or dusts attached to the polishing pad 5.

The conditioning apparatus of the present invention can not only scrape off the powders from the polishing pad 5 but also can polish the polishing surface of the polishing pad 5. Such polishing allows to scrape off the surface portion of the polishing surface, whereby the polishing surface not yet used for polishing which is the interior of the polishing pad can be used as a new polishing surface.

As a result, it is possible to restore the polishing ability by removing the stuffed recesses of the polishing pad after the polishing operation and exposing a new surface, thereby achieving the long use of the polishing pad. It is therefore possible to reduce the number of replacements of the polishing pad. It is also possible to condition the polishing surface of a new polishing pad, prior to the polishing operation, thereby obtaining a surface shape of a desired polishing ability.

On the polishing surface thus newly exposed, the recesses of several micrometers to several hundred micrometers are also formed by the abrasive diamond grains 20 scraping the new polishing surface.

In the following there will be explained the conditioning method.

As examples of conditioning, there will be explained the following two methods. The first conditioning method consists of executing the rotations of the polishing pad conditioner 16 and the polishing pad 5 at the same rotation speed in the same direction while the second conditioning method consists of executing the rotations of them at different rotation speeds, and each of these methods has a suitable condition. In case of employing the same rotation speed, the rotations of the polishing pad conditioner 16 and the polishing pad 5 are executed in the same direction at the same rotation speed not exceeding 1000 rpm, preferably within a range of 50 to 300 rpm.

In case of employing different rotation speeds, the ratio of the rotation speeds of the polishing pad conditioner 16 and the polishing pad 5 is selected within a range of 1:0.5 to 1.5 and the rotation speed of the polishing pad 5 is selected not exceeding 1000 rpm. Also in this case, their rotations are preferably executed in the same direction, and more preferably the polishing pad conditioner 16 executes a swinging motion.

By employing the same rotation speed for the polishing pad conditioner 16 and the polishing pad 5, it is possible to obtain an uniform relative circumferential speed at an arbitrary position in the radial direction of the polishing surface of the polishing pad 5.

Also the pressure of the polishing pad 5 exerted by the fourth driving means 13 onto the polishing pad conditioner 16 is selected within a range of 0 to 1 $kg/cm^2$.

Polishing of higher precision can be achieved by employing rotation of the polishing pad 5 and the polishing pad conditioner 16 together with the swinging motion of the polishing pad conditioner 16 by the seventh driving means 19.

In addition to the foregoing, the conditioning apparatus of the present invention may have such a configuration that the polishing surface of the polishing pad faces upwards and the polishing pad conditioner is positioned above the polishing pad.

In addition to the foregoing, the conditioning apparatus of the present invention may have such a configuration that at least one of the polishing pad 5 and the polishing pad conditioner 16 executes rotation or revolution (Hereinafter, "revolution" means the action of an object of turning around in an orbit) by motion of the second driving means 11 and the sixth driving means 18, respectively. In such case, the directions of rotation and revolution may be mutually the same or opposite, and the rotation and revolution speeds of them may be mutually the same or slightly different.

Furthermore, the conditioning apparatus of the present invention may have such a configuration of executing either of the rotations of the polishing pad and the polishing pad conditioner while the other is in a stationary state.

[Embodiment 2]

Figure 6:
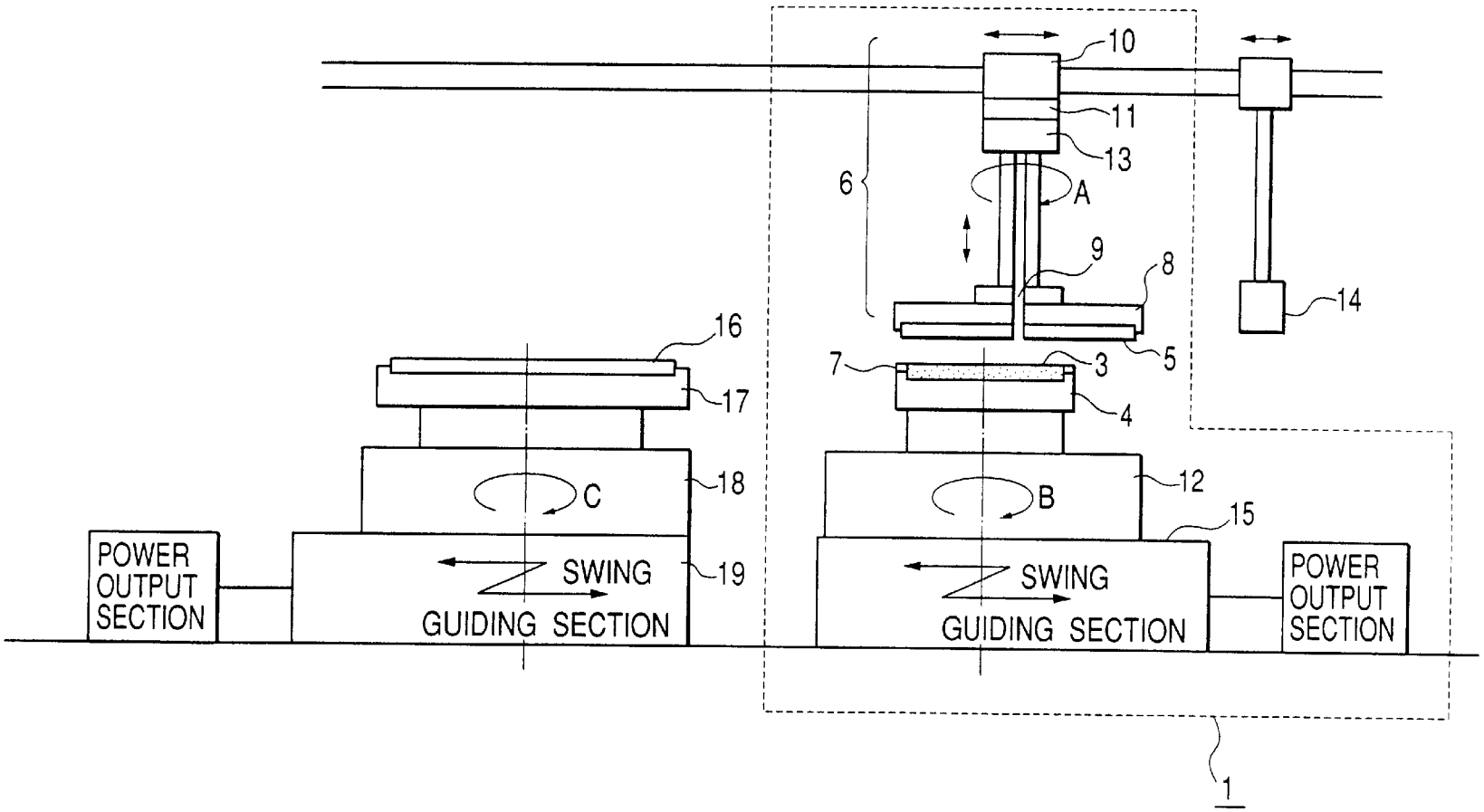
FIG. 6 is a schematic view of a conditioning station and a polishing station according to the second embodiment of the present invention.
Figure 7:
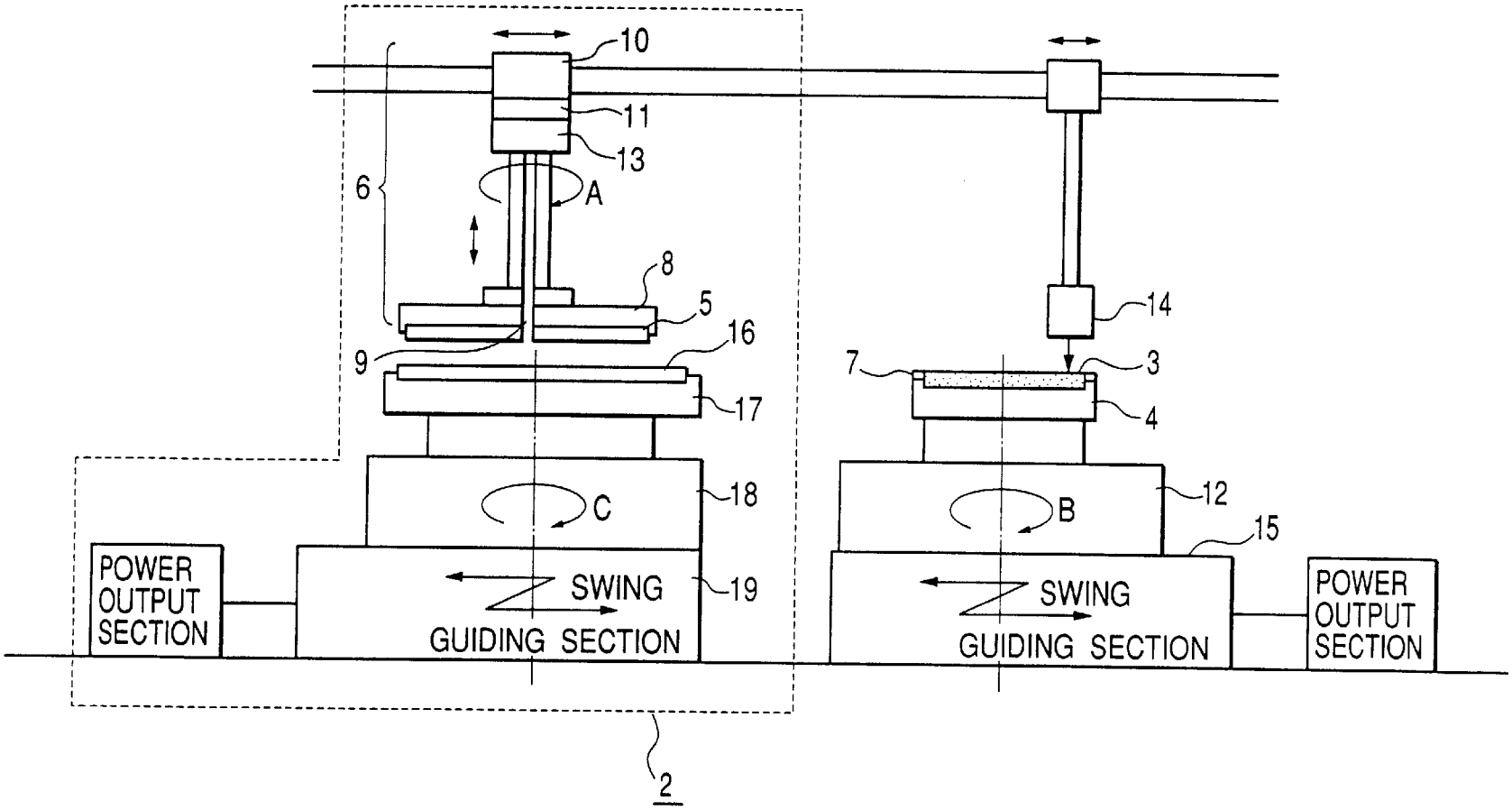
FIG. 7 is another schematic view of the conditioning station and the polishing station according to the second embodiment of the present invention.

FIGS. 6 and 7 are schematic views of a conditioning apparatus according to the second embodiment of the present invention.

Embodiment 2 of the present invention is featured by a fact that a polishing station is attached to the conditioning apparatus (polishing pad conditioning station) of the present invention. In other aspects, the apparatus of Embodiment 2 is the same as that of Embodiment 1.

FIG. 6 is a schematic view showing a state in which a polishing head 6 is positioned above polished-member support means 4 of a polishing station 1, while FIG. 7 is a schematic view showing a state in which the polishing head 6 is positioned above polishing pad conditioner support means 17.

At first, there will be explained a polishing station 1.

As shown in FIG. 6, the polishing station 1 is provided with polished-member support means 4 for supporting a member 3 to be polished in the state of facing the surface of the member 3 to be polished upwards.

The polished-member support means 4 is provided on the supporting surface thereof with a packing film (not shown in the drawings) composed of, for example, polyurethane, and supports the member 3 to be polished by fixing the back surface opposite to the surface to be polished. The polished-member support means 4 is also provided with a substantially annular guide ring 7, which supports the periphery of the member 3 to be polished, thereby avoiding lateral displacement thereof.

The member 3 to be polished is a semiconductor wafer having a diameter of 8 inches and having a material for constituting the semiconductor devices on the surface to be polished.

The polishing head 6 can move between the polishing station 1 and the polishing pad conditioning station 2 by first driving means 10, and can thus move the polishing pad 5 to a position above the member 3 to be polished.

The diameter of the polishing pad 5 supported by the polishing head 6 is larger than that of the member 3 to be polished, and more specifically within a range of not smaller than the diameter of the member 3 to be polished but smaller than twice the diameter of the member 3.

The polishing head 6 and the polished-member support means 4 respectively have second and third driving means 11 and 12 and the rotations of them are executed in respective directions of arrows A and B. Therefore, the rotations of the polishing pad 5 supported by the polishing head 6 and the member 3 to be polished supported by the polished-member support means 4 are executed in the same direction.

Each rotation speed may be arbitrarily selected within a range of several rpm to several ten thousand rpm, and both rotation speeds may be set to be mutually the same or mutually different by several rpm.

The polishing head 6 is vertically moved by the fourth driving means 13 constituting the aforementioned contact means, and is brought into contact with the member 3 to be polished. The contact pressure of the polishing pad with the member 3 to be polished can be controlled by control means not shown in the drawings.

Also as explained in the foregoing, the polishing head 6 is provided with a small hole 9 in the platen 8, and the polishing agent (slurry) is uniformly supplied, through openings provided in the polishing pad 5, to the surface of the member 3 to be polished. The slurry is, for example, an aqueous alkali solution in which abrasive grains such as of silicon oxide are dispersed. The small hole 9 is an aperture formed on the platen 8, which is an outlet of a liquid supply path penetrating through the shaft.

The small hole 9 is connected to slurry supply means and means for supplying, for example, deionized water or liquid used for conditioning (not shown in the drawings), and a liquid to be supplied therethrough can be selected according to the necessity.

The polished-member support means 4 performs, by fifth driving means 15 provided thereto, a swinging motion in the horizontal direction during the polishing operation, thereby achieving uniform polishing operation. The swinging motion has an amplitude within a range of several millimeters to several ten millimeters, and is executed with several to several ten cycles per second.

Also, the polishing pad 5 and the member 3 to be polished may be mutually contacted in such a manner that the their centers are not mutually concentric. In such state, the sum of the distance between their centers and the radius of the member 3 to be polished is selected so as not to exceed the radius of the polishing pad 5, whereby the entire surface to be polished is constantly covered by the polishing pad 5.

Since the diameter of the used polishing pad is within a range of not smaller than the diameter of the member to be polished but smaller than twice the diameter of the member, the diameter of the polishing pad is smaller than 16 inches for the member of 8 inches in diameter, or the diameter of the polishing pad is smaller than 24 inches for the member of 12 inches in diameter, so that rotation of the polishing pad can be executed at a high speed. Also since the center of the polishing pad and that of the member to be polished are positioned on mutually different axes, the unevenness of polishing due to the circumferential speed which increases proportionally to the distance from the center of rotation can be significantly reduced, so that the entire surface of the polished member can be uniformly polished.

The polishing apparatus is provided with a detection device 14 for observing the surface of the member 3 to be polished. When the member 3 is not covered by the polishing pad 5 as shown in FIG. 7, the detection device 14 can move to a position immediately above the member to be polished and can observe the surface thereof to be polished.

The detection device 14 irradiates the surface to be polished with laser light or white light and then, based on the reflected light, can measure the film thickness distribution on the surface to be polished or can pick up the surface shape of the surface to be polished as an image and can observe the magnified image of the surface shape.

Also the result of measurement on the surface to be polished is transmitted to a processing system not shown in the drawings and can be used as data for resetting a preferred polishing condition. More specifically such result can be utilized as data for specifying the timing for terminating the polishing process for each member to be polished, or as data, in case of continuous polishing of plural members to be polished, for polishing the subsequent members in more uniform manner.

In the following there will be explained the polishing method.

There will be explained the following two polishing methods. A first polishing method consists of executing the rotation of the member 3 to be polished and the polishing pad 5 at the same rotation speed in the same direction, while a second polishing method consists of employing different rotation speeds, and each of these methods has a suitable condition. In case of employing the same rotation speed, the rotations of the member 3 to be polished and the polishing pad 5 are executed in the same direction at the same rotation speed within a range of not larger than several ten thousand rpm, preferably not larger than 1000 rpm and more preferably 50 to 300 rpm.

In case of employing different rotation speeds, the ratio of the rotation speeds of the member 3 to be polished and the polishing pad 5 is selected within a range of 1:0.5 to 1.5 and the rotation speed of the polishing pad 5 is set to be not larger than 1000 rpm. Also in this case the rotations of them are preferably executed independently in the same direction, and more preferably the polished member 3 executes a swinging motion.

Also the pressure of the polishing pad 5 exerted by the fourth driving means 13 onto the member 3 to be polished is selected within a range of 0 to 1 kg/cm$^2$.

Polishing of higher precision can be achieved by executing the rotation of the member 3 to be polished and the polishing pad 5 together with the swinging motion of the polished-member support means 4 by the fifth driving means 15.

Figure 8:
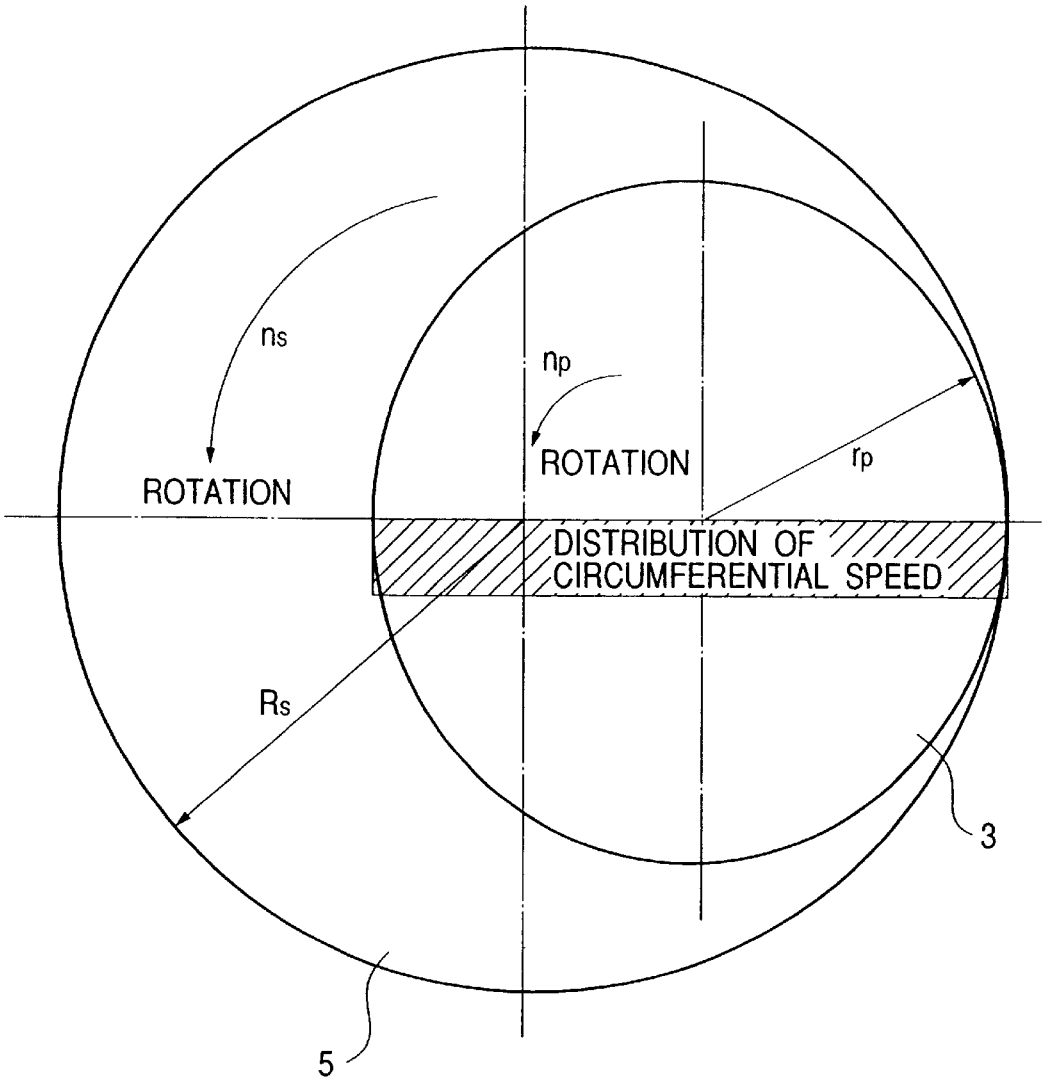
FIG. 8 is a schematic view showing the distribution of a circumferential speed.

FIG. 8 is a schematic diagram showing a region where the circumferential speed becomes constant in the member 3 to be polished in contact with the polishing pad 5. As shown in FIG. 8, the rotation number $n_p$ per unit time of the member 3 and the rotation number $n_s$ per unit time of the polishing pad 5 are selected so as to be mutually equal, whereby the relative circumferential speed becomes constant at an arbitrary position in the radial direction of the surface of the member 3 to be polished. As a result, polishing can be achieved uniformly in the radial direction.

In the following there will be explained the polishing pad conditioning station.

As explained in the foregoing, the polishing head 6 moves between the polishing station 1 and the polishing pad conditioning station 2 by the first driving means 10 and is positioned above the polishing pad conditioner support means 17. The polishing pad 5 after polishing operation is moved, together with the polishing head 6, from the polishing station 1 to the polishing pad conditioning station 2. In this position after movement, the unnecessary substances such as the polished wastes and the like are removed from the polishing surface of the polishing pad, or the removal of the unnecessary substances is executed in a state where the recesses formed by contact with the member to be polished are removed and the thickness of the entire polishing surface is made substantially uniform. Also by separating the polishing pad 5 from the polishing pad conditioner 16, the uniformity of the thickness of the polishing pad 5 can be restored over the substantially entire surface.

Figure 9:
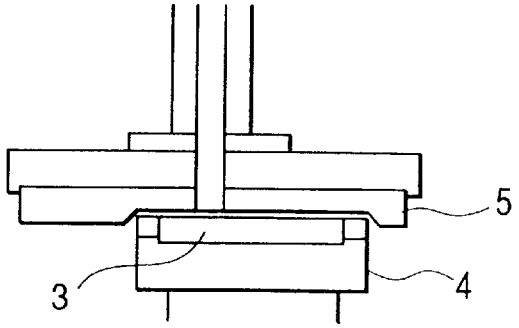
FIG. 9 is a schematic view of a member to be polished and a polishing pad in a state of mutually contacting them.
Figure 10:
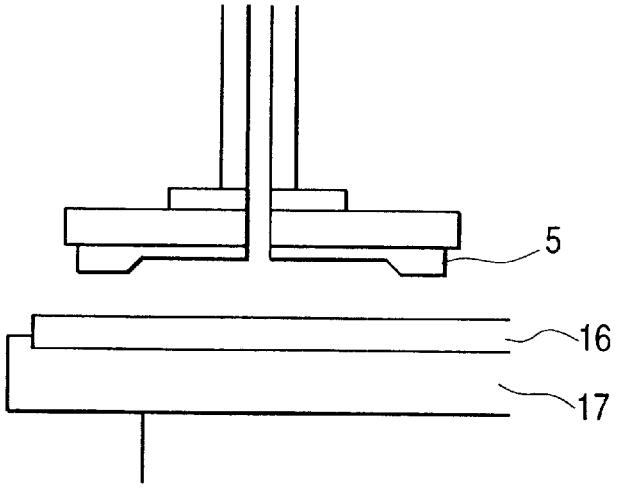
FIG. 10 is a schematic view of a recessed polishing pad and a polishing pad conditioner.
Figure 11:
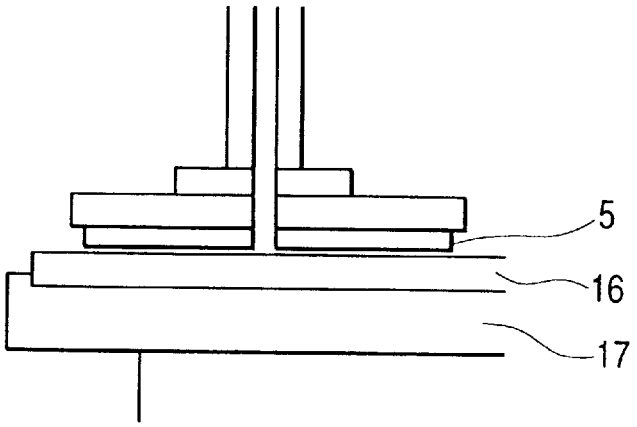
FIG. 11 is a schematic view of a polishing pad and a polishing pad conditioner in a state of mutually contacting them.

FIG. 9 is a schematic view showing the polishing pad 5 in contact with the member 3 to be polished, while FIG. 10 is a schematic view showing the polishing pad 5, after polishing of the member to be polished, positioned above the polishing pad conditioner 16, and FIG. 11 is a schematic view showing the polishing pad 5 in contact with the polishing pad conditioner 16.

As explained in the foregoing, since the polishing pad 5 is in contact with the member 3 to be polished of a smaller area under a pressure, the polishing pad 5 becomes recessed in the portion where the pad frequently contacts with the member 3 to be polished, as shown in FIG. 9.

As shown in FIG. 10, the thickness of the polishing pad 5 after polishing is not uniform over the entire surface. More specifically, the thickness of the polishing pad 5 becomes smaller in a portion where the polishing pad more frequently contacts with the member 3 to be polished. The portion of a smaller thickness shows a higher density in comparison with other portions, because of the pressure applied thereto.

In the conditioning operation, as shown in FIG. 11, the polishing pad 5 is in contact with the polishing pad conditioner 16 under a substantially uniform pressure over the entire surface. Therefore, the recess of the polishing pad 5, which is formed in the polishing operation, is removed and the conditioning is uniformly made over the entire surface. The uniformly reduced thickness of the polishing pad over the entire surface under the pressure of contact uniformly recovers over the entire surface by the separation of the polishing pad 5 from the polishing pad conditioner 16, whereby the recess is removed.

As explained above, the conditioning apparatus of the present invention not only can remove the polished wastes from the polishing surface of the polishing pad 5 but also can eliminate the recess formed during the polishing operation, thereby restoring the uniform thickness of the polishing pad 5 over the entire surface thereof. As a result, the polishing pad 5 can recover the polishing ability many times by the conditioning operation whereby the number of replacements of the polishing pad can be reduced and the manufacturing cost can be lowered.

Also in the present invention, the diameters of the member to be polished, the polishing pad and the polishing pad conditioner are selected so as to satisfy a relationship of (polishing pad conditioner 16)>(polishing pad)>(member to be polished). Also according to the present invention, the diameter of the polishing pad conditioner is set to be not larger than 4 times that of the member to be polished, so that the polishing head 6, the polished-member support means 4 and the polishing pad conditioner support means 17 can be made compact to save the space required for the apparatus. Furthermore, since the polishing head 6, the polished-member support means 4 and the polishing pad conditioner support means 17 have small diameters, the rotation and revolution of them can be executed at a high speed.

Furthermore, the consumed amount of the polishing agent or the conditioning liquid is minimized because the polishing pad and the polishing pad conditioner have small areas, so that the manufacturing cost can be reduced.

In the following there will be explained the conditioning method.

There will be explained the following two polishing methods. The first polishing method consists of executing the rotation of the polishing pad conditioner 16 and the polishing pad 5 at the same rotation speed in the same direction, while the second polishing method consists of employing different rotation speeds, and each of these methods has a suitable condition. In case of employing the same rotation speed in the same direction, the rotations of the polishing pad conditioner 16 and the polishing pad 5 are executed in the same direction at the same rotation speed of not larger than 1000 rpm, preferably within a range of 50 to 300 rpm.

In case of employing different rotation speeds, the ratio of the rotation speeds of the polishing pad conditioner 16 and the polishing pad 5 is selected within a range of 1:0.5 to 1.5, and the rotation speed of the polishing pad 5 is selected in a range not exceeding 1000 rpm. Also in this case, the rotations of them are preferably executed in the same direction, and more preferably the polishing pad conditioner 16 executes a swinging motion.

By employing the same rotation speed for the polishing pad conditioner 16 and the polishing pad 5, the relative circumferential speed becomes constant at an arbitrary position in the radial direction of the polishing surface of the polishing pad 5. As a result, there can be attained a constant polishing amount in the radial direction of the polishing pad 5.

Also the pressure of the polishing pad 5 exerted by the fourth driving means 13 onto the polishing pad conditioner 16 is selected within a range of 0 to 1 kg/cm$^2$.

Polishing of higher precision can be achieved by executing rotation of the polishing pad conditioner 16 and the polishing pad 5, together with the swinging motion of the polishing pad conditioner 16 by the seventh driving means 19.

The polishing apparatus to which the conditioning device of the present invention is attached may cause rotation of the polishing head 6 and the polished-member support means 4 not only in the same direction but also in the mutually opposite directions. Also the polishing of the member 3 to be polished may be achieved, not only by the rotations of the polishing head 6 and the polished-member support means 4, but also, for example, by only the rotation of the polishing head 6, while the polished member support means 4 is in a stationary state. In such case, it is not necessary to arrange the second driving means 11 for revolving the polished-member support means 4. It is also possible to execute the rotation of the polished-member support means 4 while the polishing head 6 is in a stationary state.

Furthermore, the conditioning apparatus of the present invention may cause rotations of the polishing head 6 and the polishing pad conditioner support means 17 not only in the same direction but also in the mutually opposite direction. Also the conditioning of the polishing pad 5 may be achieved, not only by the rotations of the polishing head 6 and the polishing head conditioner support means 17, but also, for example, by only the rotation of the polishing head 6, while the polishing head conditioner support means 17 is in a stationary state. In such case, it is not necessary to arrange the sixth driving means 18 for executing the rotation of the polishing pad conditioner support means 17. It is also possible to execute the rotation of the polishing pad conditioner support means 17 while the polishing head 6 is in a stationary state.

The polishing apparatus to which the conditioning apparatus of the present invention is attached may adopt, instead of the configuration for polishing the member 3 to be polished under the swinging motion of the member 3 by the fifth driving means 15 provided on the polished-member support means 4, another configuration in which the fifth driving means 15 is provided, for example on the polishing head 6. Furthermore, the swinging means may be provided with both of the polished-member support means 4 and the polishing head 6.

The conditioning apparatus of the present invention may adopt, instead of the configuration for conditioning the polishing pad 5 under the swinging motion of the polishing pad conditioner 16 by the seventh driving means 19 provided on the polishing pad conditioner support means 17, another configuration in which the seventh driving means 19 is provided, for example, with the polishing head 6. Furthermore, the seventh driving means 19 may be provided with both of the polishing pad conditioner support means 17 and the polishing head 6.

The polishing apparatus to which the conditioning apparatus of the present invention is attached may also adopt a configuration in which the first driving means 10 is provided with the polished-member support means 4 and the polishing pad conditioner support means 17 to render them movable in a vertical direction with respect to the polishing head 6.

Also in the polishing apparatus to which the conditioning apparatus of the present invention is attached, the rotation speeds of the polishing pad 5 and the member 3 to be polished are selected within a range of several ten rpm to several ten thousand rpm. In this case, preferably selected rotation speeds are mutually different, for example, by several rpm.

Such polishing mode is particularly effective in case of polishing the member 3 to be polished with a polishing pad having grid-patterned, concentric or radial grooves on the polishing surface. Specifically, it is possible to prevent transfer of the groove pattern of the polishing pad 5 onto the surface to be polished.

Also in the conditioning apparatus of the present invention, the polishing head 6 may be provided with revolution driving means not shown in the drawings, and the rotation or revolution of the polishing head 6 may be executed. Otherwise, the polished-member support means 4 in place of the polishing head 6 may be provided with the revolution driving means not shown in the drawings, and the rotation or revolution of the polished-member support means 4 may be executed, or such revolution driving means may be provided at both the polishing head 6 and the polished-member support means 4.

Otherwise the revolution driving means may be provided at either of the polishing head 6 and the polished-member support means 4 while the other is in a stationary state.

The rotation and revolution may be executed in the same direction or mutually opposite directions, but the latter is preferred because the polishing can be achieved with high precision.

The speeds of the rotation and revolution may be individually selected, but are preferably set to be the same or mutually different by several rpm, thereby being able to achieve polishing of high precision.

Also in the conditioning apparatus of the present invention, the polishing head conditioner support means 17 may be provided with revolution driving means not shown in the drawings, and the rotation or revolution of the polishing head conditioner 16 may be executed.

Otherwise, the polishing head 6 may be provided with the revolution driving means not shown in the drawings, and the rotation or revolution of the polishing head 6 may be executed, or both of the polishing head conditioner support means 17 and the polishing head 6 may be provided with such revolution driving means.

Otherwise, either of the polishing head 6 and the polishing head conditioner support means 17 may be provided with the revolution driving means not shown in the drawings, while the other is in a stationary state.

The rotation and revolution may be executed in the same direction or mutually opposite directions, but the latter is preferred because the polishing can be achieved with high precision.

The speeds of rotation and revolution may be individually selected, but preferably selected speeds are the same or mutually different by several rpm, thereby being able to achieve polishing of high precision.

Also in the polishing apparatus to which the conditioning apparatus of the present invention is attached, the polishing head 6 may be positioned below the polished-member support means 4, instead of being positioned thereabove. In such configuration, the polishing pad conditioner support means 17 is preferably positioned above the polishing head 6, in order to improve the functionality of the apparatus.

Also in the conditioning apparatus of the present invention, in addition to the supply of the conditioning liquid from the small hole 9 provided in the polishing head 6, there may be provided conditioning liquid supply means for supplying a conditioning liquid between the polishing pad 6 and the polishing pad conditioner 16 from the outside of the polishing pad 6, thereby positively removing the polished wastes and the abrasive grains attached to the polishing pad 6.

Furthermore, in the conditioning apparatus of the present invention, the polishing pad 5 may be provided with holes for discharging a liquid or may be composed of a material allowing penetration of a liquid or a porous material.

The polishing agent employed in the present invention is a polishing liquid composed of fine particles of a relatively uniform particle size in a range from several millimeters to submicron, such as of manganese oxide, silicon oxide, cerium oxide, aluminum oxide, zeolite oxide, chromium oxide, iron oxide, silicon carbide, boron carbide, carbon or ammonium salts, dispersed in an aqueous solution of sodium hydroxide, potassium hydroxide, ammonia, isocyanulic acid, Br—$CH_3OH$, isopropyl alcohol or hydrochloric acid. The combination of the fine particles and the solution can be suitably selected according to the purpose. For example, for Si surface polishing, it is suitable to use a polishing agent consisting of fine particles of silicon oxide, cerium oxide, an ammonium salt or manganese dioxide dispersed in the above-mentioned solution. Also a polishing agent consisting of fine particles of silicon oxide dispersed in an aqueous solution of potassium hydroxide is suitable for $SiO_2$ surface polishing, and a polishing agent consisting of fine particles of silicon oxide dispersed in an aqueous ammonia solution containing hydrogen peroxide is suitable for aluminum surface polishing. There may also be employed a liquid containing a component capable of dissolving the surface to be polished, and such component is an oxidizing component such as iron chloride or hydrogen chloride, which can be utilized for etching a metal component of the surface to be polished. Furthermore, such component may also be a strongly alkaline component which can etch the surface to be polished by hydrolysis.

The member to be polished in the precision mechanical polishing apparatus of the present invention can be, for example, a semiconductor wafer such as of silicon or gallium arsenide, or a wafer containing at least one material for constituting the semiconductor device such as a transistor. Other examples of the member to be polished include an SOI substrate and a substrate for display device.

The conditioning liquid to be employed in the present invention is preferably composed of a main component which is the same as that of the solvent employed in the slurry. Specific examples thereof include aqueous solutions of sodium hydroxide, potassium hydroxide, ammonia, isocyanulic acid, Br—$CH_3OH$,hydrochloric acid and alcohol, and deionized water. Particularly polishing agent and conditioning agent containing isopropyl alcohol are preferred for achieving uniform polishing of the member to be polished and effective conditioning.

Also in the conditioning apparatus of the present invention, the polishing pad conditioner is preferably composed of a member not easily deformed under a load, for example, a resinous material, ceramics or a metal. Also the conditioning surface of such member is preferably provided with minute surface irregularities having a step difference (difference in height between a protruded portion and a recessed portion in surface irregularities) and a pitch (distance between the adjacent protruded portions in surface irregularities), both in a range of several micrometers to several hundred micrometers, in order to improve the conditioning effect.

Figure 12:
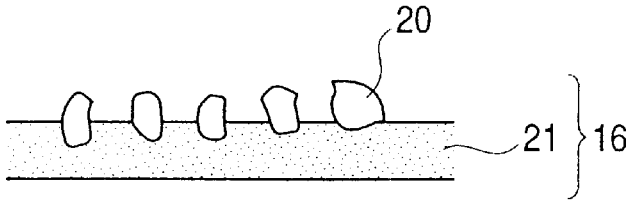
FIG. 12 is a schematic magnified view of a polishing pad conditioner of the present invention.
Figure 13:
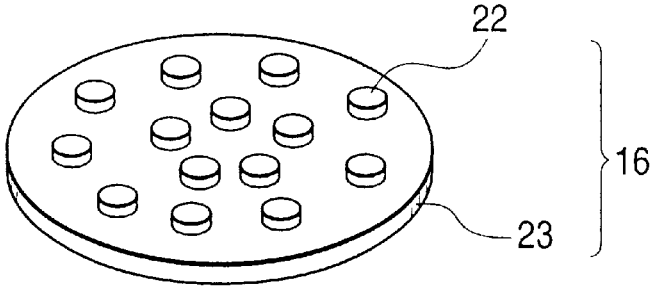
FIGS. 13 and 14 are schematic views showing other polishing pad conditioners of the present invention.
Figure 14:
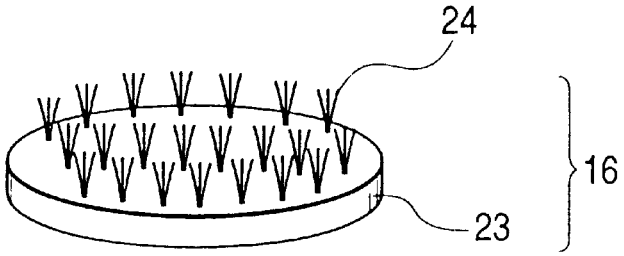

FIGS. 12, 13 and 14 show examples of the shape of the polishing pad conditioner that can be employed in the present embodiment. FIG. 12 shows a part of the polishing pad conditioner 16 explained in Embodiment 1. In the polishing pad conditioner 16, the abrasive diamond grains 20 are supported on a substrate 21 such as polyurethane over the entire surface to be in contact with the polishing pad. Also FIG. 13 shows another example of the polishing pad conditioner 16 formed by arranging a plurality of ceramic cylindrical blocks (called pins) 22 on a disk 23, and FIG. 14 shows another example of the polishing pad conditioner 16 formed by planting a nylon or metal brush 24 on a disk 23.

The member to be polished in the present embodiment can be, for example, a semiconductor wafer having a material for constituting semiconductor devices, an SOI substrate, or a bare wafer. The member to be polished in the present invention also includes a rectangular substrate for a display device.

The diameter of the member to be polished may be of any size, but in practice it is 6, 8 or 12 inches or larger. Also in the present embodiment, the diameter of the polishing pad may be smaller than that of the member to be polished.

[Embodiment 3]

Figure 15:
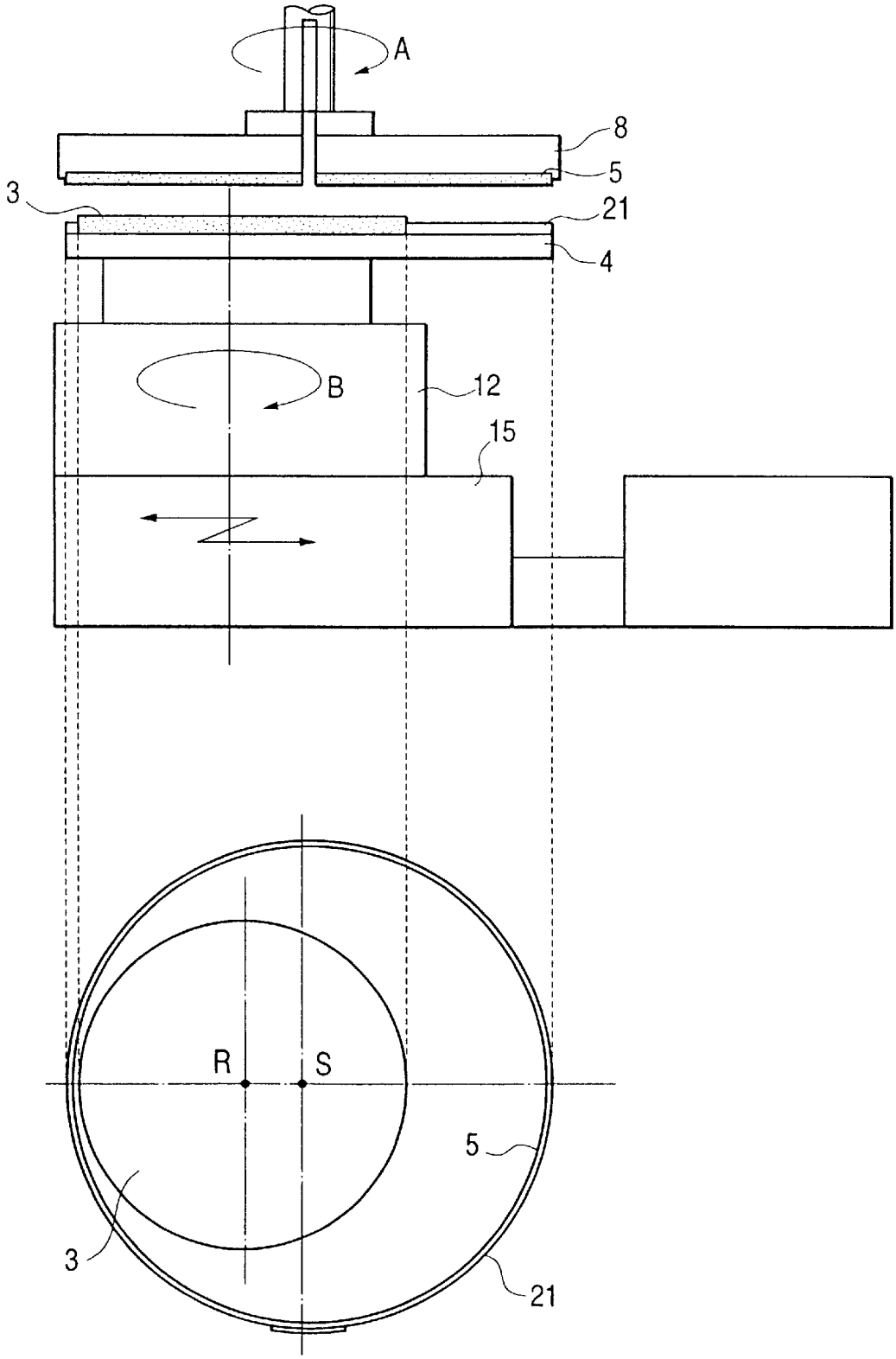
FIG. 15 is a schematic view of a polishing head and polished-member support means according to the third embodiment of the present invention.

FIG. 15 is a schematic view showing a guide ring 21 of the polishing apparatus according to Embodiment 3 of the present invention, and the upper part of FIG. 15 is a schematic side view while the lower part of FIG. 15 is a schematic plan view. Embodiment 3 is featured by a fact that the diameter of the guide ring 21 is larger than that of the polishing pad 5, in order to prevent displacement of the member to be polished in the horizontal direction. Other aspects of Embodiment 3 are the same as those in Embodiments 1 and 2.

The guide ring 21 has a space for supporting the member 3 to be polished, and is provided to support the member 3 in such a state that the center R of the member 3 is different from the center S of the polishing pad. The diameter of the above-mentioned space is selected so as to support the member 3. The centers R and S are positioned so that the sum of the distance between the center R of the member 3 and the center S of the polishing pad 5 and the radius of the member 3 is smaller than the radius of the polishing pad 5.

The polishing operation is executed by respective rotations of the member 3 to be polished and the polishing pad 5, without the rotation of the guide ring 21.

In the present embodiment, the guide ring 21 is brought into contact with the entire surface of the polishing pad 5. In this state the polishing pad 5 receives a uniform pressure over the substantially entire surface to exhibit uniform deformation over the entire surface, whereby its thickness becomes uniform over the entire area. As a result, the polishing pad 5 does not generate a large recess and can therefore be more effectively and uniformly conditioned over the entire surface in the conditioning station 2.

EXAMPLE

In this example, the polishing pad was conditioned with the conditioning apparatus of Embodiment 2 of the present invention, and was used for polishing the member to be polished.

Figure 16:
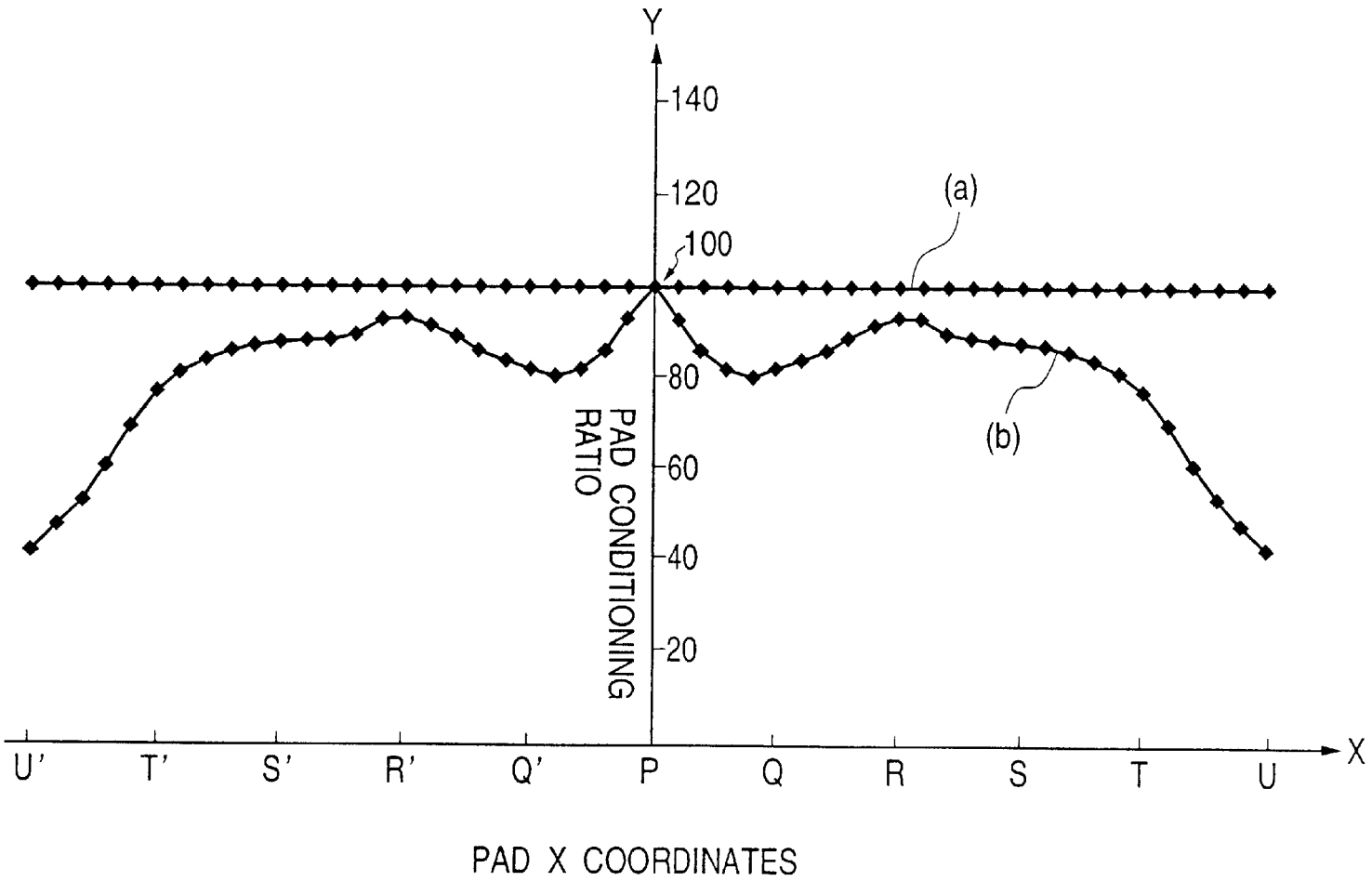
FIG. 16 is a graph showing the pad conditioning ratio for the polishing pad.

FIG. 16 shows the conditioning ratio of the polishing pad 5, conditioned by the conditioning station shown in FIGS. 6 and 7.

Figure 17:
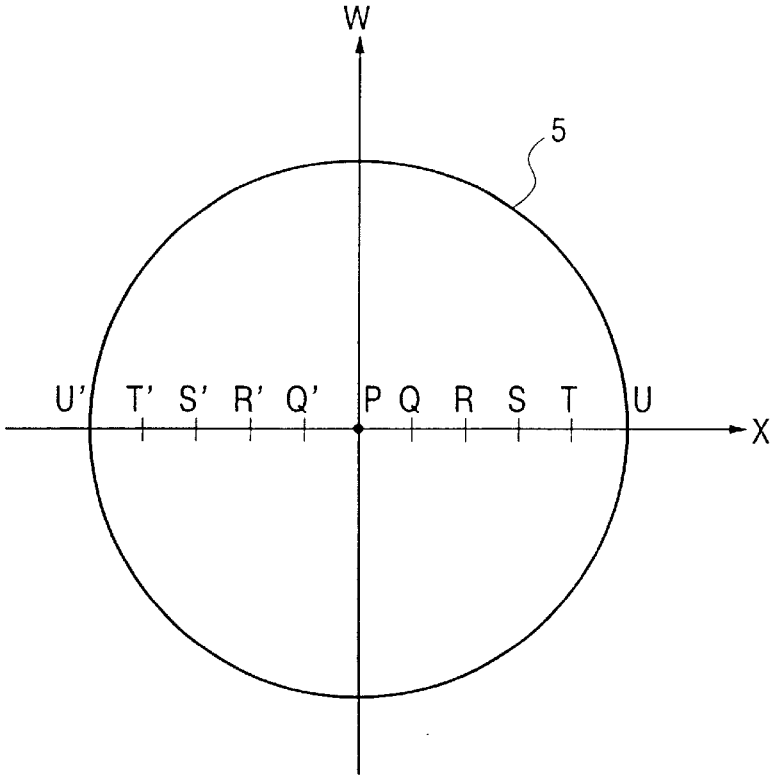
FIG. 17 is a schematic view showing the X-axis shown in FIG. 16 on the polishing pad.

Also FIG. 17 is a schematic view showing the shape of the polishing pad and points U', T', S', R', Q', P, Q, R, S, T and U corresponding to those on the X-axis in FIG. 16.

In FIG. 16, the X-axis indicates the points P, Q, R, S, T, U, Q', R', S', T' and U' positioned at a constant interval on the diameter of the polishing pad 5 passing through the center P thereof, and the Y-axis indicates the pad conditioning ratio.

The pad conditioning ratio means the percentage of the pad conditioning amount at an arbitrary position along the diameter of the polishing pad 5, by taking the pad conditioning amount at the center P thereof as 100%. The pad conditioning amount means the amount of the polishing pad 5 scraped off per unit time by the polishing pad conditioner 16.

The measurement is conducted by optically observing the surface of the member to be observed, and the observation is made in a circular area with a diameter of about 25 $\mu$m, i.e. about 490 $\mu m^2$, around each of the points P, Q, R, S, T, U, Q', R', S', T' and U'.

In this case, the polishing pad 5 has a diameter of 300 mm, and the polishing pad conditioner 16 has a diameter of 380 mm. The distance between the central axis of the polishing pad 5 and that of the polishing pad conditioner 16 is 20 mm, and the polishing pad 5 is contacted with the polishing pad conditioner 16 under a pressure of 50 g/cm$^2$. The rotation speed of the polishing pad 5 is 150 rpm while that of the polishing pad conditioner 16 is 148 rpm.

The line (a) in FIG. 16 indicates the conditioning ratio of the polishing pad along the diameter direction thereof, which is conditioned by the conditioning apparatus of this example.

Figure 1:
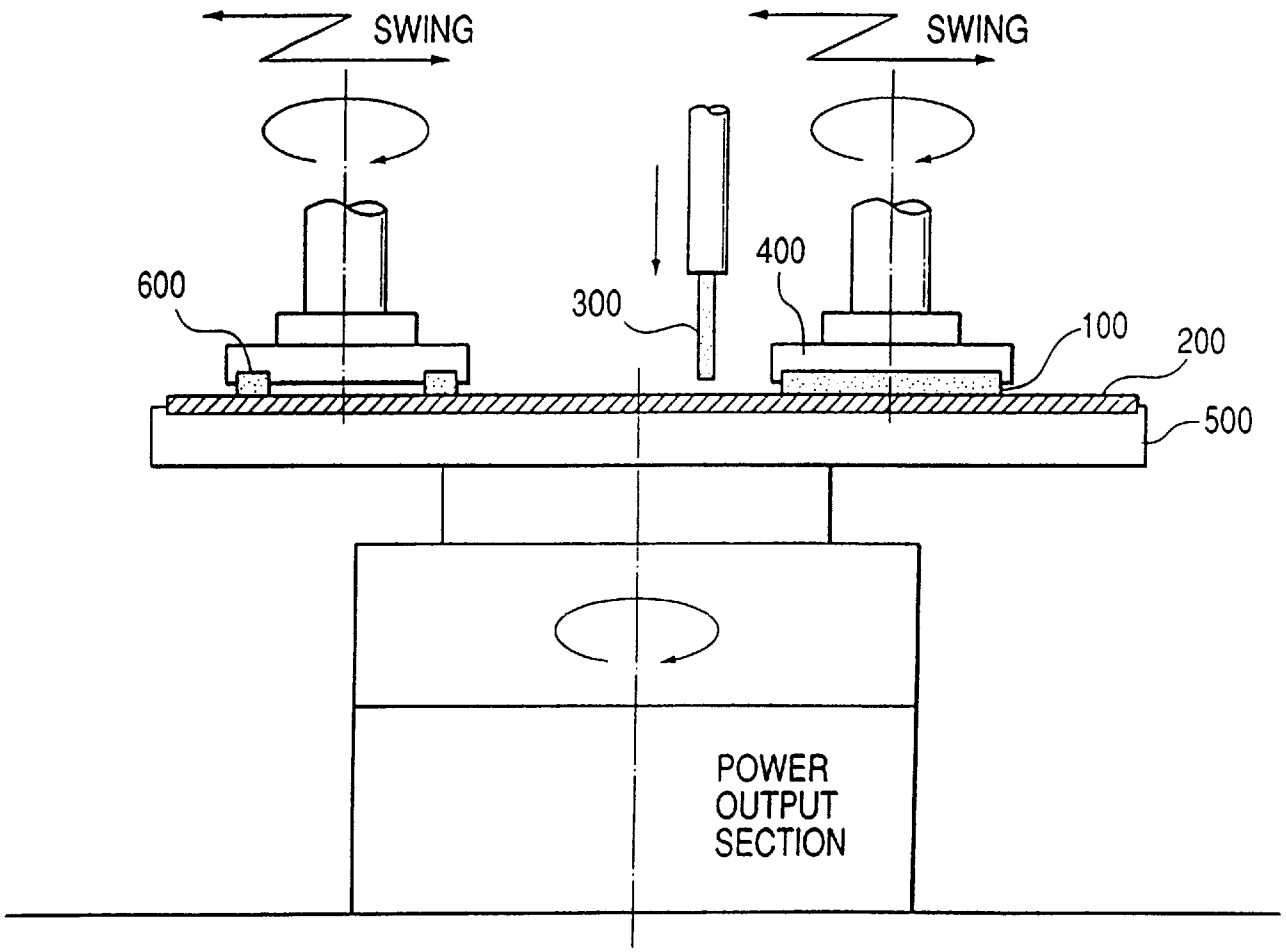
FIG. 1 (PRIOR ART)
FIG. 1 is a schematic view of a polishing apparatus.

Also the line (b) in FIG. 16 indicates the conditioning ratio of the polishing pad as a comparative example, obtained by using the conditioning apparatus shown in FIG. 1 in which the conditioning is executed by conditioning means for swinging the polishing pad.

Figure 2:
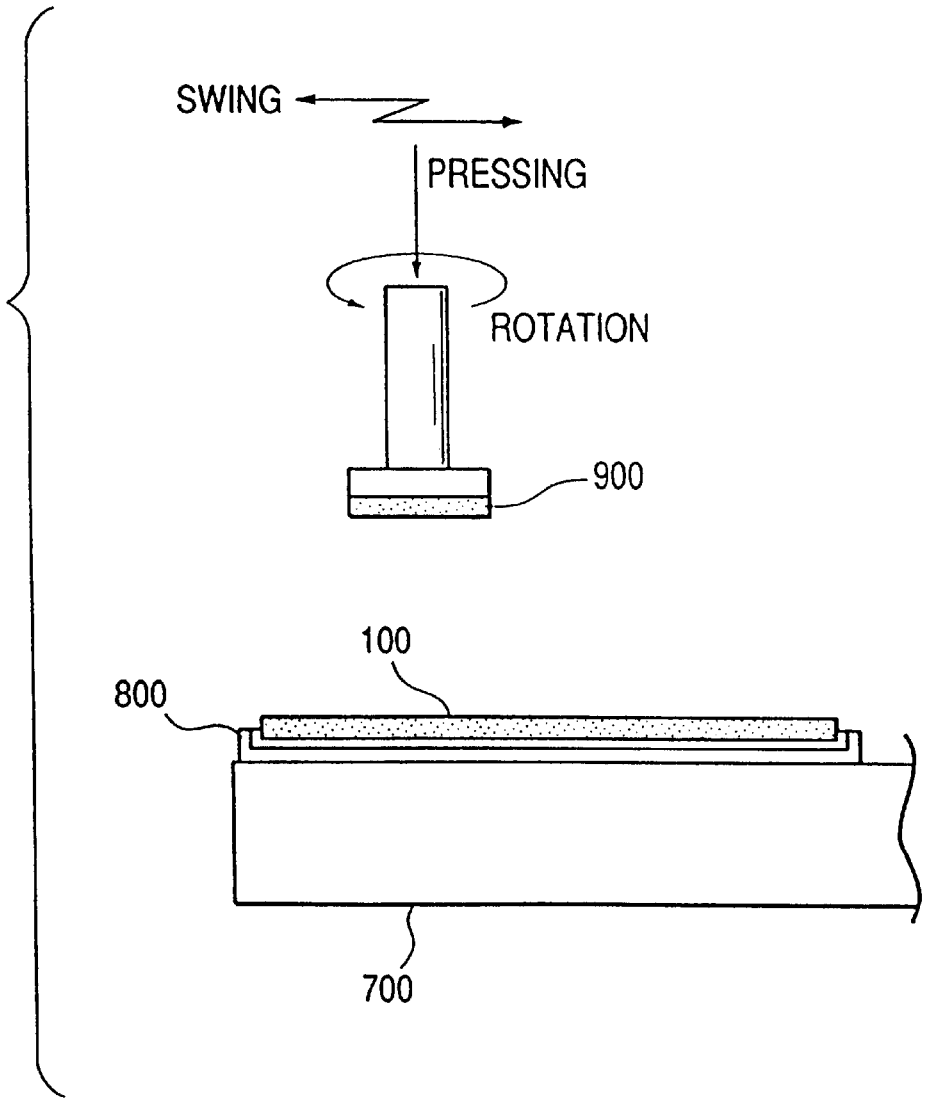
FIG. 2 (PRIOR ART)
FIG. 2 is a schematic view of another polishing apparatus.

As indicated by the line (a) in FIG. 16, the polishing pad 5 conditioned by the conditioning apparatus of this example was uniformly conditioned over the entire surface. On the other hand, in the comparative example conditioned with the conditioning apparatus shown in FIG. 2, the pad conditioning ratio was uneven on the polished surface and was significantly lower in the external peripheral portion of the polishing pad.

Figure 18:
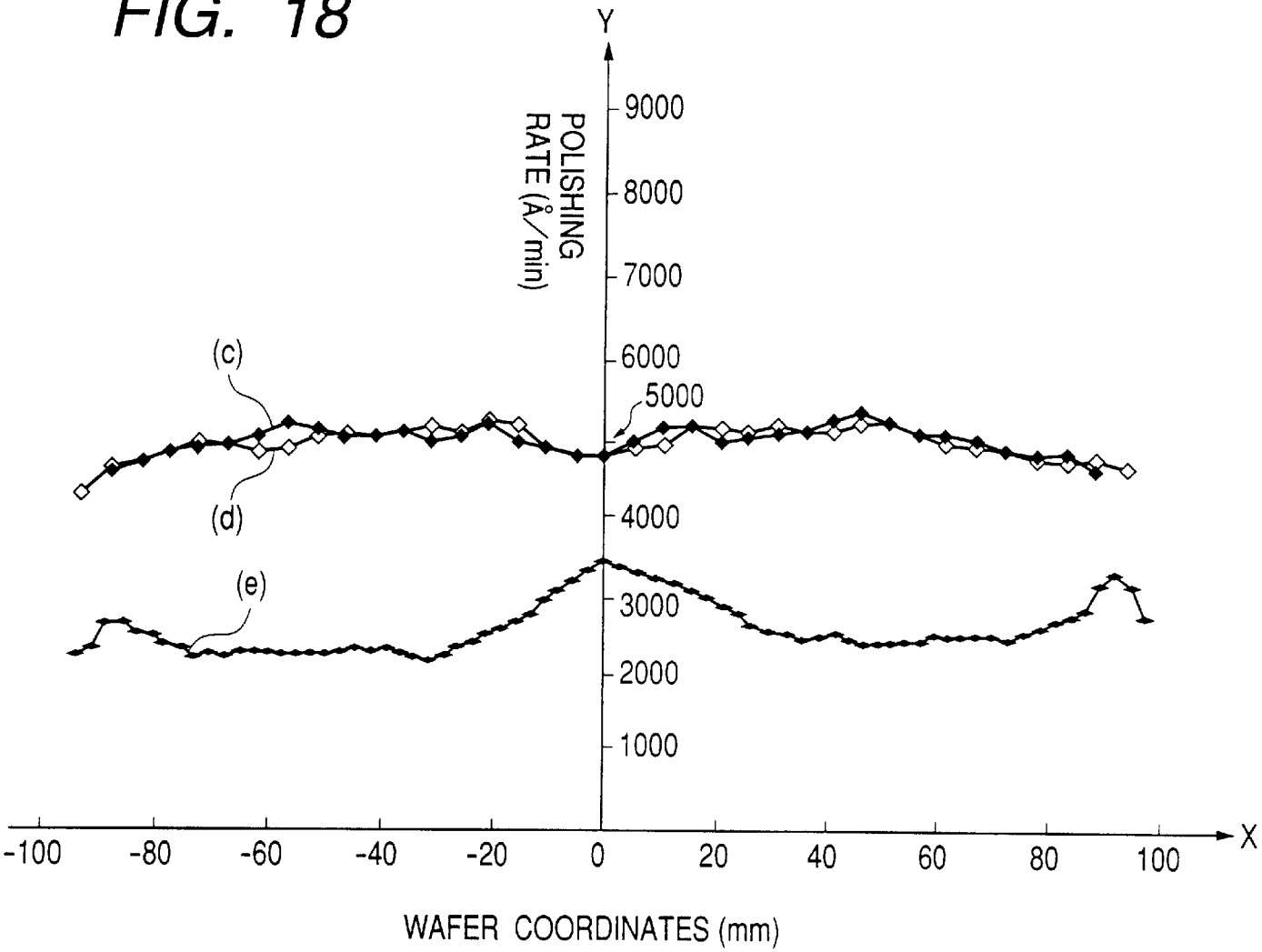
FIG. 18 is a graph showing the polishing rate of a member to be polished.

FIG. 18 shows the distribution of the polishing rate on the member 3 to be polished, in case it is polished with the polishing pad 5 conditioned with the conditioning station 2.

Figure 19:
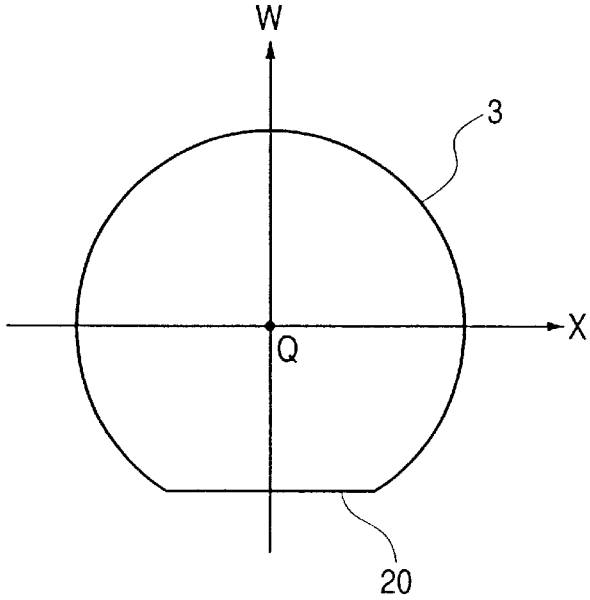
FIG. 19 is a schematic view showing the X-axis shown in FIG. 18 on a member to be polished.

In FIG. 18, the X-axis indicates the distance in the radius direction from the center Q of the member 3 to be polished shown in FIG. 19, while the Y-axis indicates the polishing rate. As shown in FIG. 19, the member 3 to be polished has an orientation flat 20.

The polishing rate means the reduced thickness by polishing of the member to be polished per unit time.

In this case, the polishing pad 5 has a diameter of 300 mm, and the member 3 to be polished has a diameter of 200 mm. The distance between the central axis of the polishing pad 5 and that of the member 3 is 40 mm, and the polishing pad 5 is contacted with the member 3 under a pressure of 300 g/cm$^2$. The rotation speed of the polishing pad 5 is 300 rpm while the rotation speed of the member 3 is 299 rpm.

The line (c) in FIG. 18 indicates the polishing rate in the X-axis direction when the member 3 to be polished shown in FIG. 19 is polished with the polishing station 1, and the line (d) in FIG. 18 indicates the polishing rate in the W-axis direction.

The polishing rate was measured by optically observing the surface of the member to be measured, and the observation was made in a circular area with a diameter of about 20 $\mu$m, i.e. about 314 $\mu m^2$, around each measuring point on each coordinate axis.

As indicated by the (c), the polishing of the member 3 to be polished with the polishing station 1 made it possible to extremely reduce the variation in the polishing rate between the center and the external periphery of the polished member. As indicated by the line (d), the polishing with the polishing station also made it possible to significantly reduce the variation in the polishing rate between the center Q and the orientation flat, whereby the substantially circular member to be polished having the orientation flat could be uniformly polished over the entire surface.

The line (e) in FIG. 18 indicates a comparative example, showing the polishing rate in case the member to be polished was polished with the polishing apparatus shown in FIG. 1. The polishing pad employed in the comparative example was conditioned with the pad conditioning ratio indicated by the line (b) in FIG. 16. As indicated by the line (e), in the polishing with the polishing apparatus shown in FIG. 1, the polishing rate was low over the entire surface and uniform polishing over the entire surface could not be achieved.

The present invention makes it possible to precisely condition the entire surface of the polishing pad for a short time, by using the polishing pad conditioner with an area larger than that of the polishing pad. As a result, there can be improved the processing speed and the production yield, thereby lowering the manufacturing cost. Further, the thus conditioned polishing pad can be used for achieving uniform polishing of the member to be polished over the entire surface thereof.

What is claimed is:

1. A conditioning apparatus comprising:

a polishing head for supporting a polishing pad;

polishing pad condition support means for supporting a polishing pad conditioner having a conditioning surface with an area larger than that of a polishing surface of said polishing pad;

contacting means for contacting said polishing pad supported by said polishing head and said polishing pad conditioner supported by said polishing pad condition support means; and polished-member support means for supporting a member to be polished having a diameter smaller than a diameter of said polishing pad.

2. A conditioning apparatus according to claim 1, wherein the diameter of said polishing pad is larger than the diameter of the member to be polished but smaller than twice the diameter of the member.

3. A conditioning apparatus according to claim 1, further comprising detection means for detecting a polished surface of the member to be polished.

4. A conditioning apparatus according to claim 1, wherein at least one of said polishing head and said polished-member support means has swinging means.

5. A conditioning apparatus according to claim 1, further comprising first rotation means for rotating said polishing head and second rotation means for rotating said polished-member support, wherein the rotational movement of said polishing head and said polished-member support means is in the same direction.

6. A conditioning apparatus according to claim 1, further comprising first rotation means for rotating said polishing head and second rotation means for rotating said polished-member support, wherein a rotational speed of said polishing head and said polished-member support means are substantially the same.

7. A conditioning apparatus according to claim 1, further comprising first rotation means for rotating said polishing head and second rotation means for rotating said polished-member support, wherein a rotational speed of said polishing head and said polished-member support means are different by at least several rpm.

8. A conditioning apparatus according to claim 1, wherein said polished-member support means supports the member to be polished in a state of facing a surface thereof to be polished upwards.

9. A conditioning apparatus according to claim 1, wherein said polished-member support means supports a guide ring adapted to surround a periphery of the member to be polished and having an external diameter larger than the diameter of said polishing pad.

10. A conditioning apparatus according to claim 9, wherein the rotation of said guide ring is not executed but is fixed.

11. A conditioning method comprising the steps of:

conditioning a polishing pad by contacting the polishing pad and a polishing pad conditioner having a conditioning surface with an area larger than that of a polishing surface of the polishing pad; and polishing, by the polishing pad, a member to be polished having a diameter smaller than a diameter of the polishing pad.

12. A conditioning method according to claim 11, wherein the diameter of the polishing pad is larger than the diameter of the member to be polished but smaller than twice the diameter of the member.

13. A conditioning method according to claim 11, wherein the polishing is executed in a state that the sum of a distance between a central axis of the polishing pad and a central axis of the member to be polished and a radius of the member to be polished is not larger than a radius of the polishing pad.

14. A conditioning method according to claim 11, further comprising a step of detecting a polishing state of a polished surface of the member to be polished by detection means.

15. A conditioning method according to claim 11, wherein the member to be polished is polished in a swinging motion by swinging at least one of the polishing pad and the member to be polished.

16. A conditioning method according to claim 11, wherein a surface of the member to be polished is polished by discharging a liquid from a hole provided in a polishing head supporting the polishing pad.

17. A conditioning method according to claim 11, further comprising the step of providing a rotational movement of the polishing pad and the member to be polished in the same direction.

18. A conditioning method according to claim 11, further comprising the step of providing a rotational movement of the polishing pad and the member to be polished at substantially the same speed.

19. A conditioning method according to claim 11, further comprising the step of providing a rotational movement of the polishing pad and the member to be polished at different speeds by several rpm.

20. A conditioning method according to claim 11, further comprising the step of supporting the member to be polished in a state of facing a face thereof to be polished upwards.

21. A conditioning method according to claim 11, wherein the member to be polished is supported by a polished-member support having a guide ring adapted to surround a periphery of the member to be polished and having an external diameter larger than the diameter of the polishing pad.

22. A conditioning method according to claim 21, wherein a rotation of the guide ring is not executed during the polishing.

23. A conditioning method according to claim 21, wherein the guide ring is fixed during the polishing.

24. A conditioning method according to claim 21, wherein the member to be polished is a substrate provided with a material constituting a semiconductor device on a surface thereof to be polished.

25. A conditioning apparatus according to claim 5, wherein said first rotating means rotates said polishing head in one of either a rotational direction about its central axis or a revolving direction about another axis different from its central axis, and said second rotating means rotates said polished-member support means in one of either a rotational direction about its central axis or a revolving direction about another axis different from its central axis.

26. A conditioning apparatus according to claim 6, wherein said first rotating means rotates said polishing head in one of either a rotational direction about its central axis or a revolving direction about another axis different from its central axis, and said second rotating means rotates said polished-member support means in either one of a rotational direction about its central axis or a revolving direction about another axis different from its central axis.

27. A conditioning apparatus according to claim 7, wherein said first rotating means rotates said polishing head in one of either a rotational direction about its central axis or a revolving direction about another axis different from its central axis, and said second rotating means rotates said polished-member support means in either one of a rotational direction about its central axis or a revolving direction about another axis different from its central axis.

28. A conditioning method according to claim 17, wherein the rotational movement of the polishing pad and the member to be polished is one of either a rotational direction about their respective central axes or a revolving direction about axes different from their respective central axes.

29. A conditioning method according to claim 18, wherein the rotational movement of the polishing pad and the member to be polished is one of either a rotational direction about their respective central axes or a revolving direction about axes different from their respective central axes.

30. A conditioning method according to claim 19, wherein the rotational movement of the polishing pad and the member to be polished is one of either a rotational direction about their respective central axes or a revolving direction about axes different from their respective central axes.

* * * * *

UNITED STATES PATENT AND TRADEMARK OFFICE

CERTIFICATE OF CORRECTION

PATENT NO. : 6,270,396 B1
DATED : August 7, 2001
INVENTOR(S) : Shinzo Uchiyama

It is certified that error appears in the above-identified patent and that said Letters Patent is hereby corrected as shown below:

Column 4,
Line 65, "such" should read -- such that --.

Column 11,
Line 19 and 21, "head" should read -- pad --.

Column 12,
Lines 27, 31 and 35, "head" should read -- pad --.
Line 57, "pad 6" should read -- head 6 --.
Line 59, "pad 6," should read -- pad 5, --.
Line 60, "pad" should read -- head --.

Column 13,
Line 39, "Br $-CH_3OH$,hydrochloric" should read -- Br $-CH_3OH$, hydrochloric --.

Column 16,
Lines 24 and 31, "condition" should read -- conditioner --.
Lines 49, 55 and 61 "support" should read -- support means --.

Signed and Sealed this

Ninth Day of April, 2002

*Attest:*

*Attesting Officer*

JAMES E. ROGAN
*Director of the United States Patent and Trademark Office*